US011248812B2

(12) United States Patent
Sjöberg

(10) Patent No.: US 11,248,812 B2
(45) Date of Patent: Feb. 15, 2022

(54) FILTER ARRANGEMENT, HUMIDIFYING DEVICE COMPRISING A FILTER ARRANGEMENT AND METHOD FOR CLEANING A HUMIDIFYING FILTER MEMBER OF A HUMIDIFYING DEVICE

(71) Applicant: Electrolux Appliances Aktiebolag, Stockholm (SE)

(72) Inventor: Fredrik Sjöberg, Stockholm (SE)

(73) Assignee: Electrolux Appliances Aktiebolag

( * ) Notice: Subject to any disclaimer, the term of this patent is extended or adjusted under 35 U.S.C. 154(b) by 42 days.

(21) Appl. No.: 16/759,862

(22) PCT Filed: Oct. 30, 2017

(86) PCT No.: PCT/EP2017/077785
§ 371 (c)(1),
(2) Date: Apr. 28, 2020

(87) PCT Pub. No.: WO2019/086101
PCT Pub. Date: May 9, 2019

(65) Prior Publication Data

US 2020/0284453 A1 Sep. 10, 2020

(51) Int. Cl.
*F24F 6/06* (2006.01)
*B01F 3/04* (2006.01)
(Continued)

(52) U.S. Cl.
CPC ..... *F24F 6/06* (2013.01); *B01F 3/04* (2013.01); *F24F 6/16* (2013.01); *F24F 13/28* (2013.01);
(Continued)

(58) Field of Classification Search
CPC ..... B01F 3/04; F24F 6/16; F24F 6/06; F24F 13/28
See application file for complete search history.

(56) References Cited

U.S. PATENT DOCUMENTS 5,896,751 A 4/1999 Wakizaka et al.
2012/0161343 A1 6/2012 Ha et al.

FOREIGN PATENT DOCUMENTS

CN 1178310 A 4/1998
CN 203294943 U 11/2013
(Continued)

OTHER PUBLICATIONS

International Search Report and Written Opinion for International Application No. PCT/EP2017/077785, dated Jul. 2, 2018, 10 pages.
(Continued)

*Primary Examiner* — Robert A Hopkins
(74) *Attorney, Agent, or Firm* — RatnerPrestia

(57) ABSTRACT

A filter arrangement for a humidifying device. The filter arrangement has: a rotatable body; a humidifying filter member arranged to be wetted with water; a guiding arrangement configured to guide water to a discharge region; and at least one discharge bucket arranged on the rotatable body. The at least one discharge bucket is configured to lift water from a tray and to discharge the water to the guiding arrangement as the rotatable body rotates in a first direction about a rotational axis. A humidifying device comprising a filter arrangement and a method for cleaning a humidifying filter member of a humidifying device are also provided.

15 Claims, 15 Drawing Sheets

(51) Int. Cl.
*F24F 13/28* (2006.01)
*F24F 6/16* (2006.01)
*F24F 6/00* (2006.01)

(52) U.S. Cl.
CPC ..... *F24F 2006/008* (2013.01); *F24F 2221/22* (2013.01)

(56) References Cited

FOREIGN PATENT DOCUMENTS

| | | | |
|---|---|---|---|
| CN | 104603547 | A | 5/2015 |
| CN | 106662346 | A | 5/2017 |
| JP | 2010054093 | A1 | 3/2010 |
| JP | 2012042132 | A | 3/2012 |
| WO | 2010007948 | A1 | 1/2010 |
| WO | 2016002659 | A1 | 1/2016 |

OTHER PUBLICATIONS

Chinese Office Action for Chinese Application No. 201780096035.1, dated Apr. 1, 2021 with translation, 19 pages.

FILTER ARRANGEMENT, HUMIDIFYING DEVICE COMPRISING A FILTER ARRANGEMENT AND METHOD FOR CLEANING A HUMIDIFYING FILTER MEMBER OF A HUMIDIFYING DEVICE

This application is a U.S. National Phase application of PCT International Application No. PCT/EP2017/077785, filed Oct. 30, 2017, which is incorporated by reference herein.

TECHNICAL FIELD

The present invention generally relates to a filter arrangement for a humidifying device. In particular, a filter arrangement for a humidifying device, a humidifying device comprising a filter arrangement and a method for cleaning a humidifying filter member of a humidifying device, are provided.

BACKGROUND

Various types of humidifying devices exist. A humidifying device may be used to humidify air in order to increase the level of comfort. The humidifying device may be constituted by an air cleaner, an air conditioner or other purifier combination product that is configured to both humidify air and clean air. Most types of humidifying devices employ a humidifying filter.

In a typical humidifying device, ambient air is passed through a porous medium or filter wetted with water to evaporate the water into the air. The moisture-laden air created thereby may be circulated in a room by the humidifying device. The filter may for example be wetted by circulating the filter through a tray containing water. The tray may be supplied with water from a tank.

One of the main problems users of humidifying devices have is the cleaning of the device. The cleaning may comprise cleaning of the tank, the tray and the filter.

In order to clean some humidifying devices, the user needs to clean the humidifying device completely manually. This often involves disassembling the humidifying device, taking out all the components and cleaning the components manually with a brush, water and dishwashing liquid. Even when disassembling the humidifying device, some regions inside the humidifying device, especially the tray, may still be difficult to reach with a brush, due to narrow passages, corners, edges etc. For more stubborn dirt, such as limescale buildup, this manual cleaning process is however not sufficient and the use of a descaling solution is needed. The filter may be soaked in the descaling solution for a certain period of time and then rinsed thoroughly with clean water to remove any remaining descaling solution. After this process, the components need to be reassembled to the humidifying device. Thus, the cleaning of humidifying devices often requires a lot of effort from the user to achieve a satisfying result.

A further problem with this cleaning is that the components can be quite dirty and for example contain mold growth. Consequently, the humidifying device may smell bad, particularly when disassembled and when the cleaning has been insufficient. The user may also come in contact with these unhygienic components.

WO 2010007948 A1 discloses a humidifying device comprising a water tray, an air cleaning filter unit, a fan and a bucket section.

SUMMARY

One object of the present disclosure is to provide a filter arrangement for a humidifying device that enables a simple, convenient, effective, automatic, reliable and/or hygienic cleaning of the filter arrangement.

A further object of the present disclosure is to provide a filter arrangement for a humidifying device that enables cleaning of the filter arrangement without opening the humidifying device.

A still further object of the present disclosure is to provide a filter arrangement for a humidifying device that has a simple and/or compact design.

A still further object of the present disclosure is to provide a humidifying device comprising a filter arrangement solving one or more of the foregoing objects.

A still further object of the present disclosure is to provide a method for cleaning a humidifying filter member of a humidifying device solving one or more of the foregoing objects.

According to one aspect, there is provided a filter arrangement for a humidifying device, the filter arrangement comprising a rotatable body; a humidifying filter member arranged to be wetted with water; a guiding arrangement configured to guide water to a discharge region; and at least one discharge bucket arranged on the rotatable body, wherein the at least one discharge bucket is configured to lift water from a tray and to discharge the water to the guiding arrangement as the rotatable body rotates in a first direction about a rotational axis. The humidifying filter member may for example be arranged to be wetted with water from the tray or a tank.

The rotatable body may comprise a plurality of discharge buckets. The discharge buckets may be substantially evenly distributed around the circumference of the rotatable body.

As the rotatable body rotates in the first direction, the at least one discharge bucket collects water when passing through the water in the tray. The water collected in the at least one discharge bucket is elevated as the rotatable body continues to rotate in the first direction. At an upper region, e.g. on the opposite side of the rotatable body with respect to the tray, the discharge bucket discharges the collected water to the guiding arrangement for guiding the water to the discharge region. The discharge bucket then descends empty down to the tray and the cycle is repeated. The rotation of the rotatable body in the first direction may be said to constitute a discharge operation.

The guiding arrangement may for example be constituted by one or more channels, pipes and/or hoses to guide the water from a discharge bucket at the upper region of the rotatable body to the discharge region. The guiding arrangement may be oriented substantially perpendicular to the rotational axis. In order to guide the water by means of gravity, the guiding arrangement may be slightly inclined.

The guiding arrangement may pass through an opening in a housing of the humidifying device. The guiding arrangement may be completely housed within the housing when not in use and may be pulled out, e.g. when comprising a hose, through the opening in the housing for discharging water to a discharge region outside the housing. A lid may be provided to close the opening with the guiding arrangement within the housing.

The discharge region may be any region where dirty water can be discharged. The discharge region may be arranged horizontally outside the tray. In most variants, the discharge region is provided external to the humidifying device, e.g. outside of the housing of the humidifying device. The discharge region may for example be constituted by a floor drain inlet or a container adjacent to the humidifying device.

Throughout the present disclosure, the filter member may be constituted by a porous medium configured to absorb water for moisturising air passing through the medium during normal operation of the humidifying device. The normal operation may thus alternatively be referred to as a humidifying operation.

The rotatable body may be constituted by a rotatable filter frame supporting the filter member. In this case, the filter member may be supported within the rotatable body, i.e. radially inside the rotatable body with respect to the rotational axis.

According to one alternative variant, the filter member is stationary. In this variant, water may be pumped from the tank or the tray, for example by means of a wetting pump, and sprinkled on the filter member in order to wet the filter member with water from the tray. Alternatively, the stationary filter member may be partially submerged in the water in the tray such that the filter member is wetted with water from the tray by means of capillary action. A stationary filter member may have a rectangular appearance.

According to a further alternative variant, the filter member is supported on and rotatable by a further rotatable body, i.e. different from the rotatable body on which the at least one discharge bucket is arranged. In case the filter member is rotatable by means of a rotatable body (either by means of the rotatable body comprising the at least one discharge bucket or by means of a further rotatable body), the filter member may be rotated through the water in the tray, e.g. such that a segment, e.g. a circular segment, of the filter member comes in contact with the water in the tray, in order to wet the filter member with water from the tray. This type of wetting of the filter member may be referred to as dip wetting.

Each discharge bucket may comprises a spout for discharging water to the guiding arrangement. That is, the spout faces the guiding arrangement when the discharge bucket has been rotated in the first direction to the upper region of the rotatable body. Each discharge bucket may further comprise an opening for collecting water from the tray.

The filter arrangement may further comprise at least one rotatably arranged wetting bucket configured to lift water from the tray and to sprinkle the water on the filter member as the at least one wetting bucket rotates. This constitutes a further option for wetting the filter member with water from the tray.

As the at least one wetting bucket rotates, it collects water when passing through the water in the tray. The water collected in the wetting bucket is elevated as the wetting bucket continues to rotate. At an elevated region, which may or may not correspond to the upper region of the rotatable body, the wetting bucket sprinkles the collected water on the filter member to humidify the filter member. The wetting bucket then descends empty down to the tray and the cycle is repeated. The filter arrangement may comprise a plurality of wetting buckets.

The rotation of the at least one wetting bucket may be said to constitute a wetting operation. Some of the water may be absorbed by the filter member and some of the water may run through the filter member back down to the tray. A cleaning operation or cleaning mode according to the present disclosure may comprise at least one wetting operation and at least one discharge operation, such as a repeated and alternated execution of wetting operations and discharge operations.

The at least one wetting bucket may arranged on the rotatable body and may be configured to lift water from the tray and to sprinkle the water on the filter member as the rotatable body rotates in a second direction, opposite to the first direction, about the rotational axis. Thus, both the at least one wetting bucket and the at least one discharge bucket may be arranged on the rotatable body and rotate together with the rotatable body. The at least one wetting bucket and the at least one discharge bucket may face in opposite directions around the circumference of the rotatable body. In case the filter arrangement comprises a plurality of wetting buckets arranged on the rotatable body, the wetting buckets may be substantially evenly distributed around the circumference of the rotatable body.

According to an alternative variant, the at least one wetting bucket and the at least one discharge bucket face in the same direction around the circumference of the rotatable body. In this case, several pairs of one wetting bucket and one discharge bucket may be arranged around the circumference of the rotatable body. Each such pair may be constituted by a joint bucket having a dividing wall that divides the discharge bucket and the wetting bucket. Alternatively, when the at least one wetting bucket and the at least one discharge bucket face in the same direction around the circumference of the rotatable body, the at least one wetting bucket and the at least one discharge bucket may be alternatingly distributed around the circumference of the rotatable body, e.g. arranged in the same plane.

If wetting buckets and discharge buckets face in the same direction around the circumference of the rotatable body, the wetting operation and the discharge operation may be carried out simultaneously. That is, water is lifted from the tray and sprinkled on the filter member by means of the wetting buckets at the same time as water is lifted from the tray and discharged to the guiding arrangement by means of the discharge buckets.

As a possible further alternative variant, the at least one wetting bucket may be arranged on an independent wheel, i.e. independent of the rotatable body. The independent wheel may or may not be rotated about the same rotational axis as the rotatable body. The independent wheel may be rotated in the second direction or in a first direction, opposite to the second direction, in order to lift water from the tray and to sprinkle the water on the filter member as the at least one wetting bucket rotates.

The at least one wetting bucket and the at least one discharge bucket may be aligned in a direction parallel to the rotational axis. Thus, the at least one wetting bucket and the at least one discharge bucket may be arranged at the same radial distance from the rotational axis of the rotatable body. The at least one wetting bucket may be arranged closer to the filter member along the rotational axis than the at least one discharge bucket. The filter arrangement may thus comprise one row of wetting buckets and one row of discharge buckets arranged on the rotatable body. Each pair of a wetting bucket and a discharge bucket may be attached to the rotatable body, e.g. by means of snap fits.

The filter arrangement may further comprise a motor arranged to drive the rotatable body in the first direction and in a second direction, opposite to the first direction, about the rotational axis. When both the at least one wetting bucket and the at least one discharge bucket are arranged on the rotatable body, this variant enables an automatic cleaning function of the filter arrangement. That is, water, preferably containing cleaning detergent, can be circulated in the filter arrangement via the filter member when the rotatable body is rotated in the second direction (wetting operation) and the water can be discharged from the filter arrangement when the rotatable body is rotated in the first direction (discharge operation).

The motor may be configured to drive the rotatable body at at least two different speeds at least in the second direction. The motor may be electronically controlled for this purpose. The motor may drive the rotatable body to rotate in the second direction at a normal speed during normal operation (humidifying operation) of the humidifying device and drive the rotatable body to rotate in the second direction at a higher speed, higher than the normal speed, during the wetting operation.

The rotatable body may comprise driven teeth at a periphery of the rotatable body. The filter arrangement may further comprise a drive gear wheel having drive teeth in meshing engagement with the driven teeth and the motor may be arranged to drive the drive gear wheel. For example, the drive gear wheel may be arranged above the driven teeth of the rotatable body.

Alternatively, or in addition, the filter arrangement may further comprise a transmission arrangement. The transmission arrangement may comprise at least one drive gear wheel to transmit rotation of the motor to rotation of the rotatable body. Also in this case, the drive gear wheel may comprise drive teeth in meshing engagement with driven teeth on the rotatable body, e.g. on the periphery of the rotatable body. Alternatively, the transmission arrangement may comprise a belt drive to transmit rotation of the motor to rotation of the rotatable body. The belt of the belt drive may engage the rotatable body by belt teeth in meshing engagement with driven teeth on the rotatable body or by friction. This contributes to a compact design of the filter arrangement.

The transmission arrangement may be configured to establish at least two different ratios between the motor and the rotatable body. For this purpose, the transmission arrangement may comprise two drive gear wheels to establish two different gear ratios with driven teeth on the rotatable body. One drive gear wheel may drive the rotatable body in normal operation (e.g. at lower speed) and one drive gear wheel may drive the rotatable body in the cleaning mode (e.g. at higher speed). The transmission arrangement may comprise an actuator, such as a lever, to selectively engage one of the two drive gear wheels with the driven teeth on the rotatable body. Alternatively, the transmission arrangement may comprise a planetary gear to selectively establish two different ratios between the motor and the rotatable body.

The motor and the guiding arrangement may be aligned in a direction perpendicular to the rotational axis. For example, the motor may be arranged above the guiding arrangement. This contributes to a compact design of the filter arrangement.

The filter arrangement may further comprise a control unit for controlling the wetting operations and the discharge operations, e.g. to control the rotations of the rotatable body in the first direction and in the second direction. The filter arrangement may further comprise an encoder to count the number or rotations of the rotatable body, e.g. arranged on the rotatable body or on the motor. The filter arrangement may further comprise a water level sensor or switch to detect a particular water level in the tray. The filter arrangement may further comprise a flow meter to measure the water flow out from the tank or out from the housing, e.g. arranged in the guiding arrangement. Any encoder, water level sensor and/or flow meter may be in signal communication with the control unit.

According to a further aspect, there is provided a humidifying device comprising a filter arrangement according to the present disclosure. A humidifying device according to the present disclosure comprises a function to humidify air by means of the humidifying filter member. The humidifying device may be dedicated to air humidification. Alternatively, the humidifying device may be constituted by an air cleaner, an air conditioner or other purifier combination product that is configured to both humidify air and clean air (also called "2 in 1").

The humidifying device may further comprise a tray arranged below the rotatable body. The at least one wetting bucket and the at least one discharge bucket may thus be arranged to lift water from the tray.

The humidifying device may further comprise a tank. The tank and the tray may be configured such that the tray is continuously filled with water to a certain level from the tank, e.g. by means of a valve. The humidifying device may further comprise a housing. The guiding arrangement may be configured to guide the water to a discharge region outside of the housing.

According to a further aspect, there is provided a method for cleaning a humidifying filter member of a humidifying device, the method comprising wetting the filter member with water; and rotating a rotatable body in a first direction about a rotational axis such that at least one discharge bucket arranged on the rotatable body lifts water from a tray and discharges the water to a guiding arrangement for being guided to a discharge region.

The method may further comprise providing a cleaning detergent to the water. The cleaning detergent may for example be added to the water in the tank that supplies water to the tray or directly to the water in the tray.

By wetting the filter member with water containing cleaning detergent, dirt collected on and in the filter member is dissolved and dislodged. The dirty water is transported down to the tray by means of gravity.

After a certain time, e.g. when a predetermined condition is met, the at least one discharge bucket is rotated by rotating the rotatable body in the first direction and thereby lifts the dirty water from the tray and discharges the dirty water to the guiding arrangement. The guiding arrangement then guides the dirty water away from the rotatable body and the tray to the discharge region, e.g. outside the humidifying device. These two operations, i.e. the wetting operation and the discharge operation, may be repeated several times, e.g. until the predetermined condition is met.

At least one wetting bucket may be arranged on the rotatable body. In this case, the wetting of the filter member with water from the tray may comprise rotating the rotatable body in a second direction, opposite to the first direction, about the rotational axis such that the at least one wetting bucket lifts water from the tray and sprinkles the water on the filter member. Thus, the wetting operation may be carried out by rotating the rotatable body in the second direction and the discharge operation may be carried out by rotating the rotatable body in the first direction.

The rotation of the rotatable body in the second direction and the rotation of the rotatable body in the first direction may be carried out at a higher rotational speed of the rotatable body in comparison with normal operation of the rotatable body. In this manner, the cleaning time can be shortened.

The wetting of the filter member with water from the tray and the rotation of the rotatable body in the first direction may be carried out repeatedly and alternatingly. These repetitions and alternations the wetting of the filter member and the rotation of the rotatable body in the first direction provide for an automated cleaning of the filter member.

The wetting of the filter member with water from the tray and the rotation of the rotatable body in the first direction may be carried out repeatedly and alternatingly until a predetermined condition is met. The predetermined condition may be based on a time limit, a number of rotations of the rotatable body, a water level in the tray and/or a water flow out from the tank or a housing of the humidifying device.

An encoder may be used to count the number or rotations of the rotatable body. The encoder may be arranged on the rotatable body or on the motor. A water level sensor or switch may be used to detect a particular water level in the tray. Data from a water level sensor or switch may also be used to calculate a water flow out from the housing. A flow meter may be used to measure the water flow out from the tank or the housing. The flow meter may arranged after the tank or in the guiding arrangement.

BRIEF DESCRIPTION OF THE DRAWINGS

Further details, advantages and aspects of the present disclosure will become apparent from the following embodiments taken in conjunction with the drawings, wherein.

DETAILED DESCRIPTION

Figure 1:
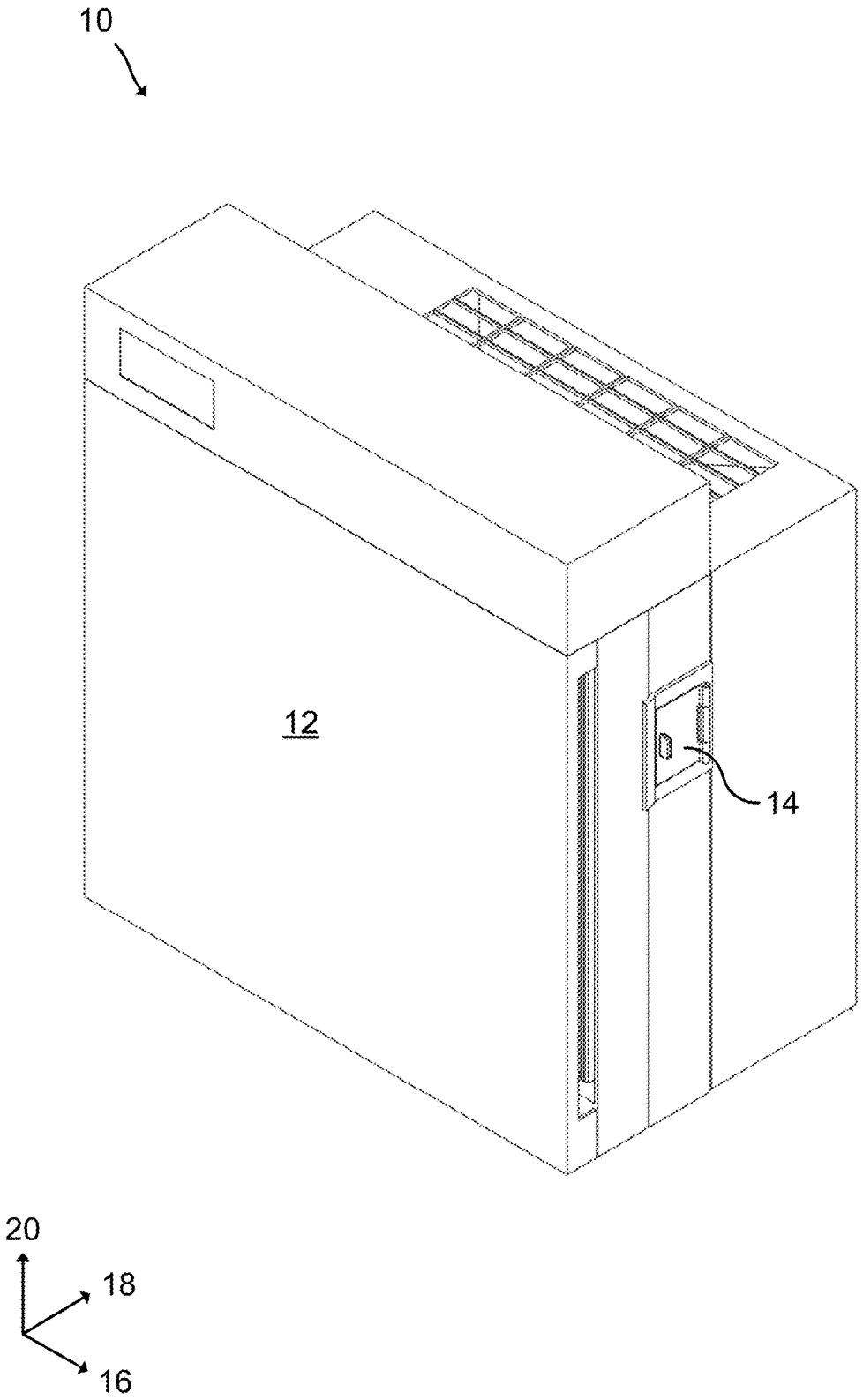
FIG. 1: represents a perspective view of a humidifying device.

In the following, a filter arrangement for a humidifying device, a humidifying device comprising a filter arrangement and a method for cleaning a humidifying filter member of a humidifying device, will be described. The same reference numerals will be used to denote the same or similar structural features.

FIG. 1 represents a perspective view of a humidifying device 10. The humidifying device 10 comprises a filter arrangement according to the present disclosure. The humidifying device 10 may or may not comprise further functions, such as a cleaning function to clean air, e.g. a cleaning arrangement arranged upstream of the filter arrangement.

The humidifying device 10 comprises a housing 12. A lid 14 is provided on one side of the housing 12 for a discharge operation which will be described in the following. FIG. 1 further denotes a first horizontal direction 16 (e.g. an X-axis), a second horizontal direction 18 (e.g. a Y-axis), perpendicular to the first horizontal direction 16, and a vertical direction 20 (e.g. a Z-axis).

Figure 2:
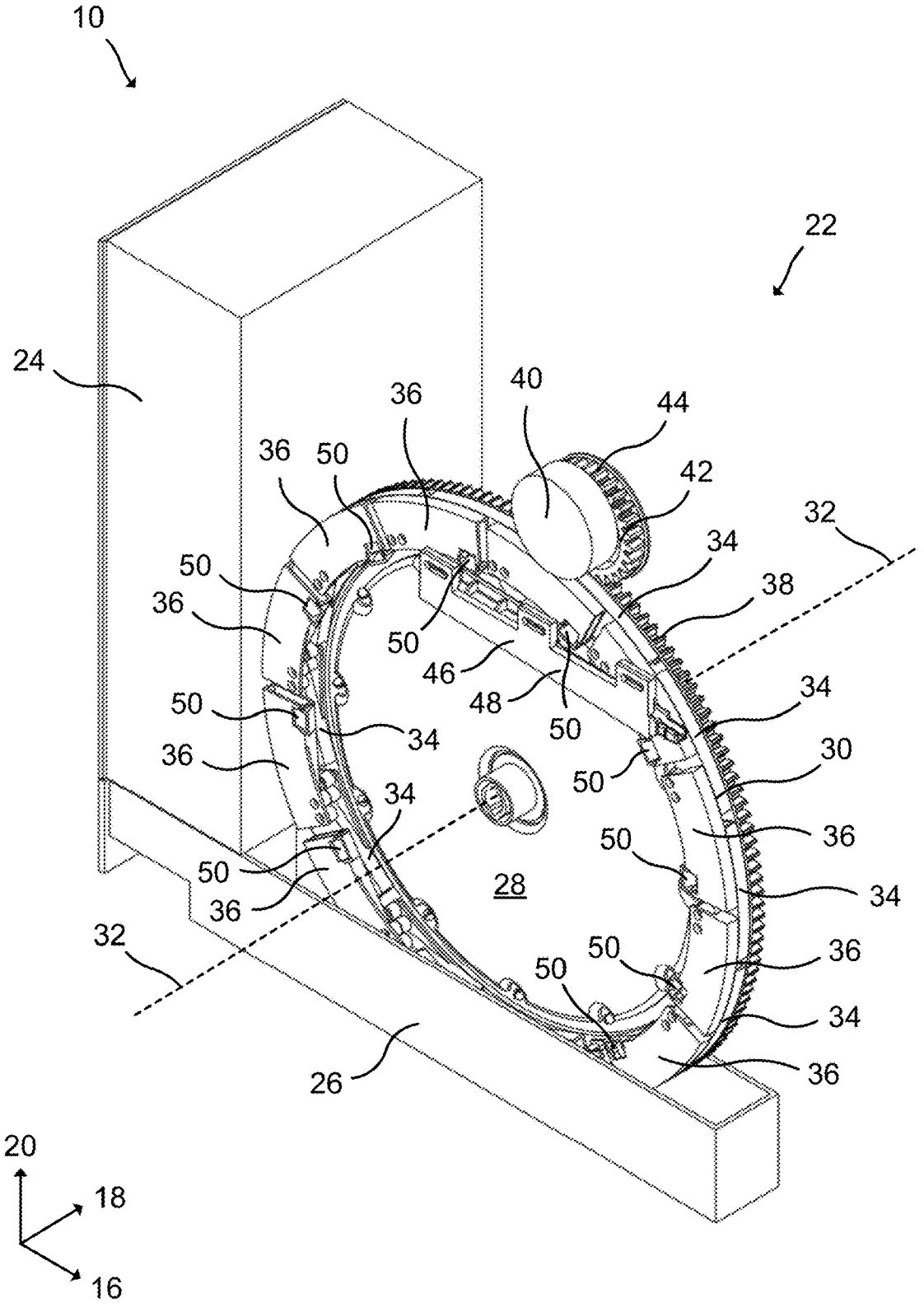
FIG. 2: represents a perspective view of the interior of the humidifying device in FIG. 1.

FIG. 2 represents a perspective view of the interior of the humidifying device 10 in FIG. 1. In FIG. 2, the housing 12 has been removed. The humidifying device 10 comprises a filter arrangement 22. The humidifying device 10 further comprises a tank 24 for being filled with water and a tray 26. The tank 24 of this example is vertically oriented at one side of the filter arrangement 22. The tray 26 is arranged below the filter arrangement 22. The tank 24 is configured to deliver water to the tray 26. The tank 24 and the tray 26 of this example may collectively house 2000 mL to 6500 mL water, for example approximately 4300 mL water.

The filter arrangement 22 comprises a humidifying filter member 28. The filter member 28 is constituted by a porous medium to absorb water in order to moisturize air passing through the filter member 28 during normal operation of the humidifying device 10.

The filter arrangement 22 further comprises a rotatable body 30. In this example, the rotatable body 30 supports the filter member 28. However, the filter member 28 may alternatively be stationary or supported by a further rotatable body.

The rotatable body 30 and the filter member 28 are arranged to rotate about a rotational axis 32. In this example, the rotatable body 30 is circular and the filter member 28 is supported radially inside the rotatable body 30.

The filter arrangement 22 further comprises a plurality of wetting buckets 34 and a plurality of discharge buckets 36. In this example, the wetting buckets 34 and the discharge buckets 36 are arranged on the rotatable body 30 and are substantially evenly distributed around the circumference of the rotatable body 30.

The wetting buckets 34 and the discharge buckets 36 are aligned parallel to the rotational axis 32. Thus, the wetting buckets 34 and the discharge buckets 36 are arranged at substantially the same radial distance from the rotational axis 32 and are arranged next to each other along the rotational axis 32. The wetting buckets 34 are arranged closer to the filter member 28 along the rotational axis 32 than the discharge buckets 36.

The rotatable body 30 further comprises driven teeth 38 for rotating the rotatable body 30. In this example, the driven teeth 38 are arranged around the periphery of the rotatable body 30.

The filter arrangement 22 further comprises a motor 40, e.g. an electric motor. The filter arrangement 22 further comprises a drive gear wheel 42 to be rotated by means of the motor 40. The drive gear wheel 42 comprises drive teeth 44 in meshing engagement with the driven teeth 38 of the rotatable body 30. The rotatable body 30 can be rotated in both directions around the rotational axis 32 by means of the motor 40. In this example, the drive gear wheel 42 constitutes a transmission arrangement.

The filter arrangement 22 further comprises a guiding arrangement 46. The guiding arrangement 46 is configured to guide water away from the rotatable body 30 and the filter member 28 to a discharge region (not shown), e.g. horizontally outside the tray 26. FIG. 2 shows that the guiding arrangement 46 comprises a channel 48, slightly inclined with respect to horizontal. The guiding arrangement 46 may comprise further components, such as a hose.

Each discharge bucket 36 comprises a spout 50 for discharging water to the guiding arrangement 46. Each discharge bucket 36 may also comprise an opening (not shown) for collecting water from the tray 26. In this example, the discharge buckets 36 are arranged between the wetting buckets 34 and the guiding arrangement 46. The spouts 50 are directed towards the guiding arrangement 46 along the rotational axis 32.

Each discharge bucket 36 is configured to collect water from the tray 26 and to discharge the water to the guiding arrangement 46. As the rotatable body 30 rotates in a first direction around the rotational axis 32 the discharge buckets 36 are dipped in the water in the tray 26 to collect water. The discharge buckets 36 carrying water are then elevated from the tray 26 to the upper region. At the upper region, the discharge buckets 36 discharge water to the guiding arrangement 46 via the spouts 50. The guiding arrangement 46 guides the water away from the filter member 28 to a discharge region. The discharge buckets 36 then return empty down to the tray 26 and the cycle is repeated.

Each wetting bucket 34 is configured to collect water from the tray 26 and sprinkle the water on the filter member 28. Both the water collection and the water sprinkling may be effected by means of an opening (not shown) in the wetting bucket 34.

As the rotatable body 30 rotates in a second direction around the rotational axis 32, opposite to the first direction, the wetting buckets 34 are dipped in the water in the tray 26 to collect water. The wetting buckets 34 carrying water are then elevated from the tray 26 to an upper region, e.g. on the opposite side of the rotatable body 30 with respect to the tray 26. At the upper region, the wetting buckets 34 sprinkle the water on the filter member 28. The wetting buckets 34 then return empty down to the tray 26 and the cycle is repeated.

During normal operation of the humidifying device 10, the motor 40 rotates the rotatable body 30 in the second direction in order to moisturize the filter member 28 with water. The water is distributed over the filter member 28 by means of capillary action. As air is drawn through the filter member 28, e.g. by means of a fan (not shown), some water in the filter member 28 is evaporated into the air and the air is humidified. The rotatable body 30 may be rotated at a normal speed during normal operation of the humidifying device 10.

In a cleaning mode, or prior to a cleaning mode, of the humidifying device 10, cleaning detergent may be added to the tank 24 or to the tray 26. This may be done automatically, e.g. by means of a cleaning detergent dispenser (not illustrated), or manually.

The cleaning mode comprises at least one wetting operation and at least one discharge operation. During the wetting operation, the rotatable body 30 is rotated in the second direction to sprinkle water containing cleaning detergent on the filter member 28 by means of the wetting buckets 34. In the wetting operation, the rotatable body 30 may be rotated at a higher speed, e.g. higher than the normal speed. The wetting operation may be carried out during, for example, 1 minute. During the wetting operation, dirt collected on and in the filter member 28 is dissolved and dislodged. The dirty water is transported down to the tray 26 by means of gravity.

After the wetting operation, the discharge operation is executed. During the discharge operation, the rotatable body 30 is rotated in the first direction to lift the dirty water from the tray 26 and discharges the dirty water to the guiding arrangement 46 by means of the discharge buckets 36. The guiding arrangement 46 then guides the dirty water away from the rotatable body 30 and the tray 26 to the discharge region, e.g. outside the humidifying device 10. Also in the discharge operation, the rotatable body 30 ay be rotated at a higher speed, e.g. higher than the normal speed. The discharge operation may be carried out during, for example, 1 minute.

After the discharge operation, a new wetting operation may be executed. If necessary, water and cleaning detergent may be added to the tank 24 or tray 26 again. Thus, the cleaning operation and the discharge operation may be carried out repeatedly and alternatingly. The last cleaning operation may be carried out with only water and no cleaning detergent for the purpose of rinsing off excess cleaning detergent.

Figure 3:
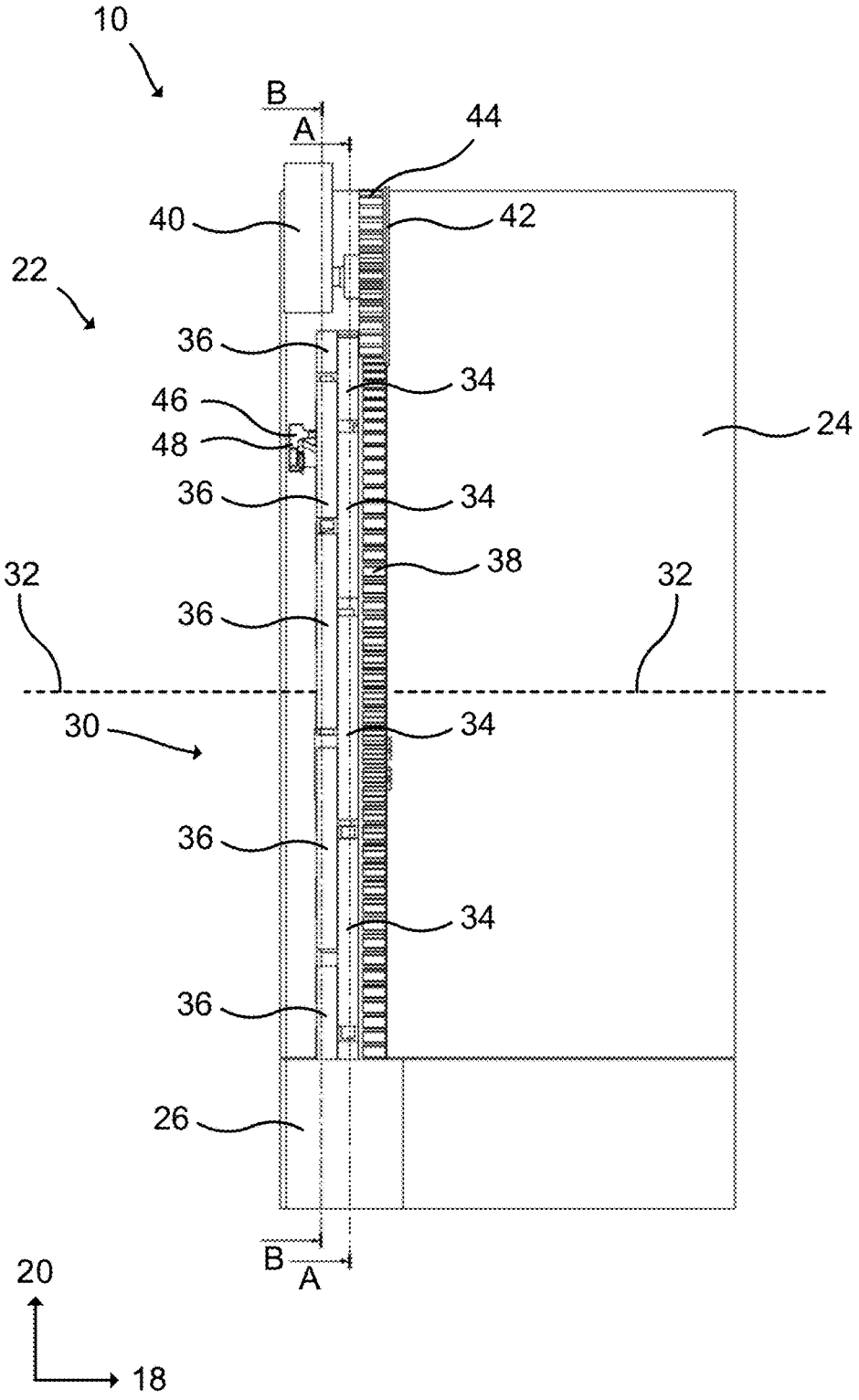
FIG. 3: represents a side view of the interior of the humidifying device in FIGS. 1 and 2.

FIG. 3 represents a side view of the interior of the humidifying device 10 in FIG. 1. FIG. 3 shows that the filter arrangement 22 is very compact, in particular along the rotational axis 32. The motor 40 is arranged above, and horizontally aligned with, the guiding arrangement 46.

Figure 4:
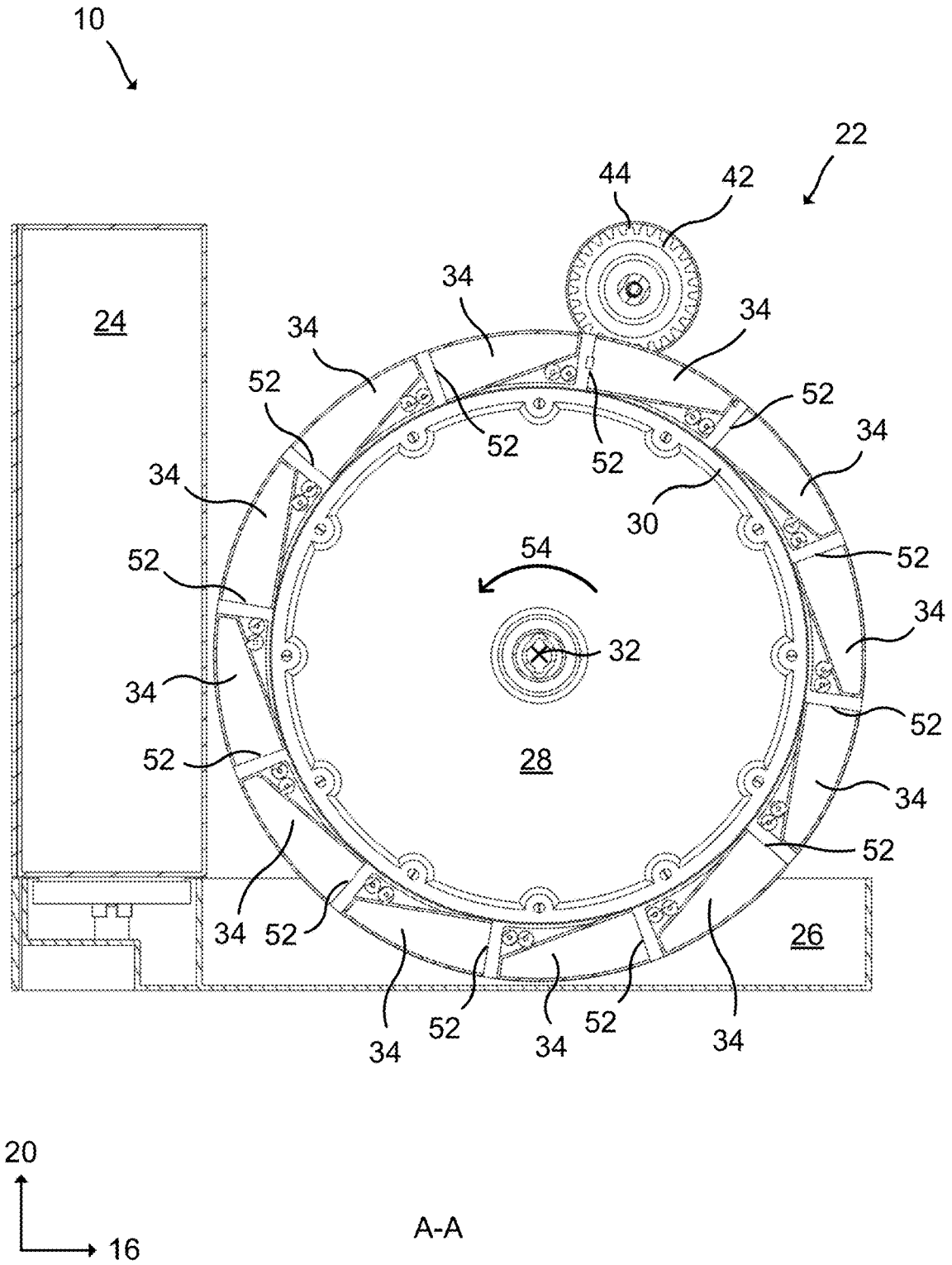
FIG. 4: represents a cross-sectional view of section A-A in FIG. 3.

FIG. 4 represents a cross-sectional view of section A-A in FIG. 3. In FIG. 4, the opening 52 of each wetting bucket 34 is shown and the second rotational direction of the rotatable body 30 is denoted as 54.

Figure 5:
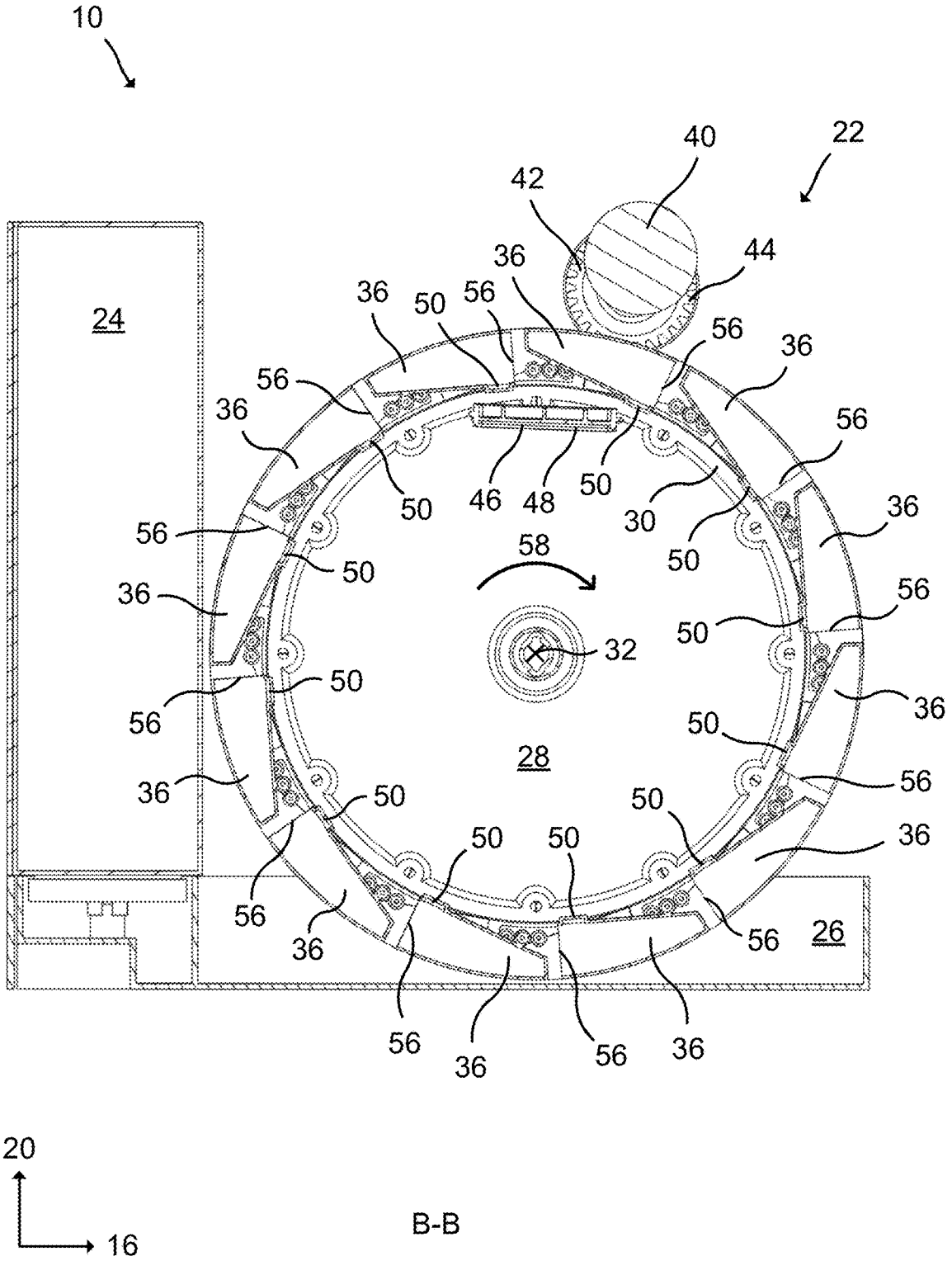
FIG. 5: represents a cross-sectional view of section B-B in FIG. 3.

FIG. 5 represents a cross-sectional view of section B-B in FIG. 3. In FIG. 5, the opening 56 of each discharge bucket 36 is shown and the first rotational direction of the rotatable body 30 is denoted as 58.

Figure 6:
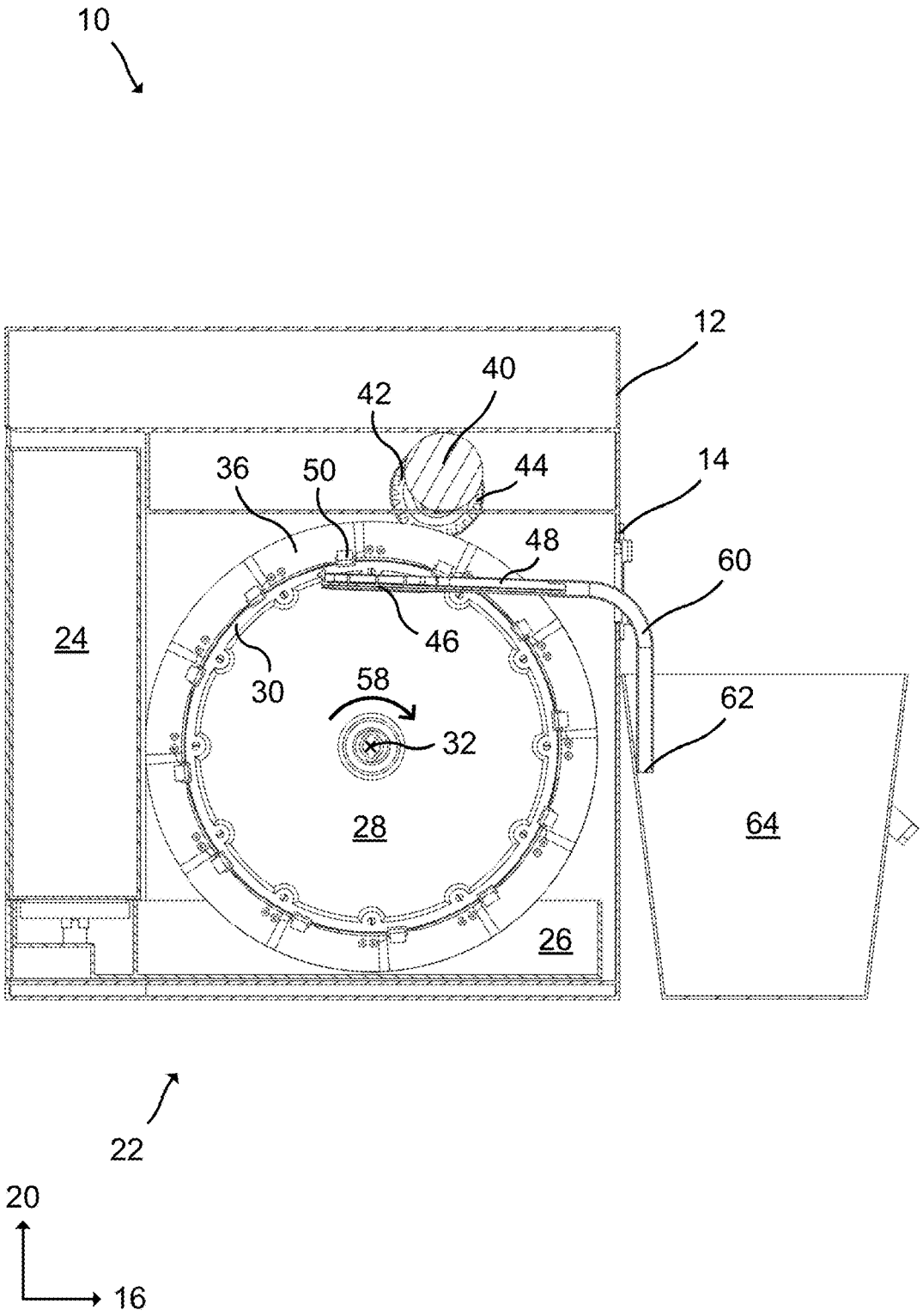
FIG. 6: represents a cross-sectional front view of the humidifying device in FIGS. 1 to 5.

FIG. 6 represents a cross-sectional front view of a humidifying device 10. In FIG. 6, the housing 12 is provided on the humidifying device 10. The guiding arrangement 46 comprises, in addition to the channel 48, a hose 60. The hose 60 opens to a discharge region 62. In this example, the discharge region 62 is provided in a container 64. However, the discharge region 62 may alternatively be provided over a drain on the floor.

In FIG. 6, the lid 14 of the housing 12 is opened and the hose 60 has been pulled through the opening associated with the lid 14. After a cleaning operation, the hose 60 may be pushed into the housing 12 and the lid 14 can be closed.

Figure 7:
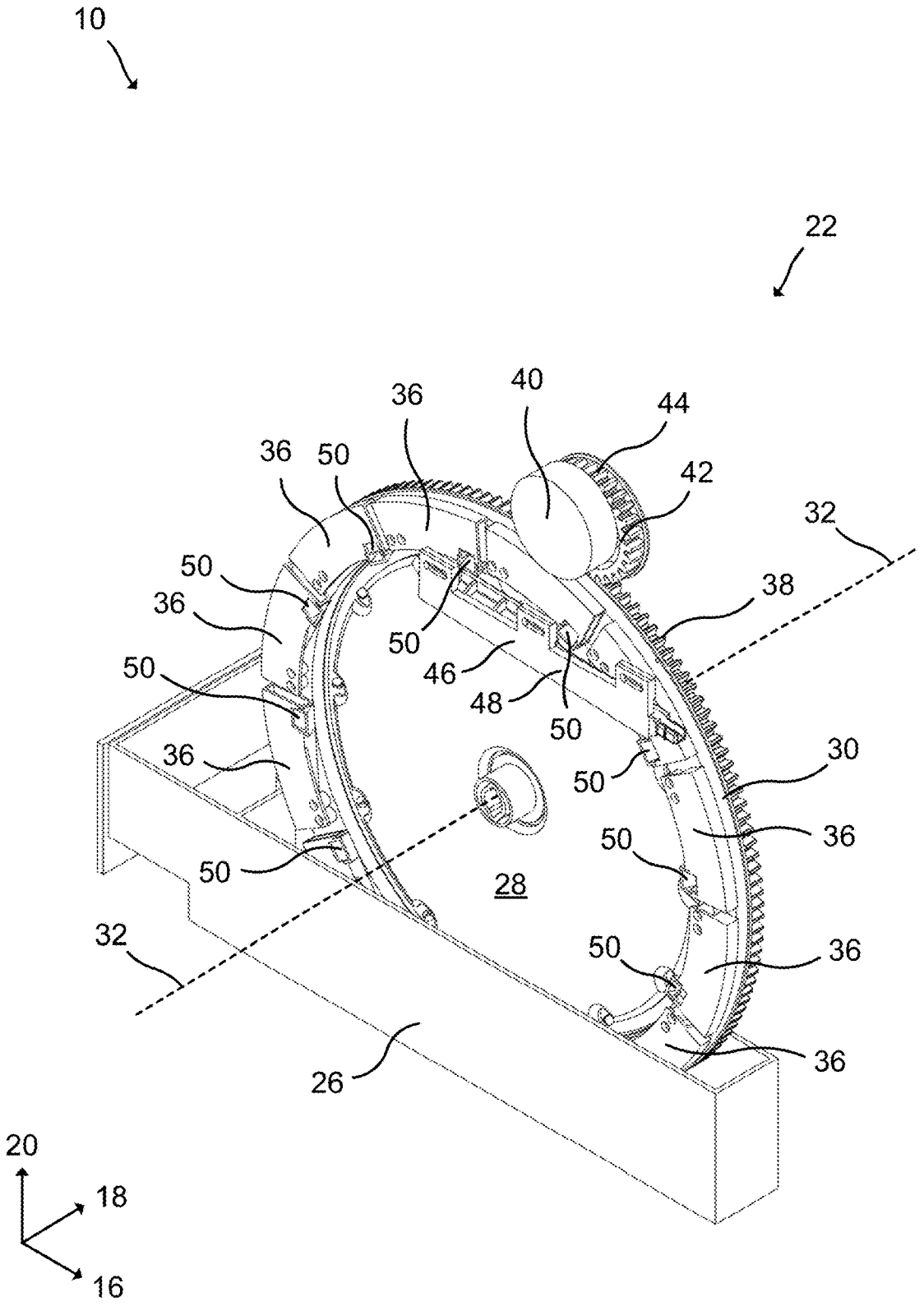
FIG. 7: represents a perspective view of the interior of a further humidifying device.
Figure 8:
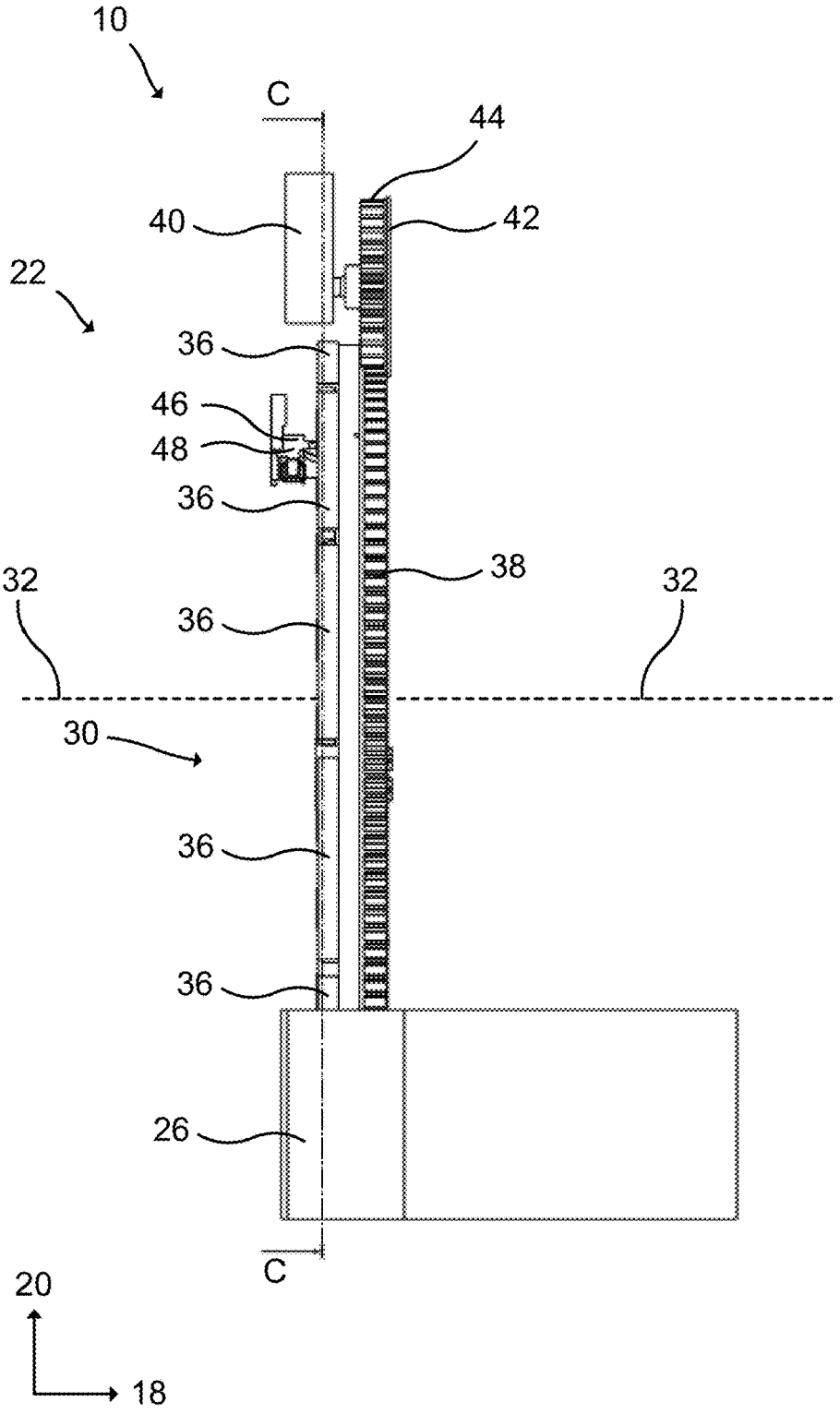
FIG. 8: represents a side view of the interior of the humidifying device in FIG. 7.
Figure 9:
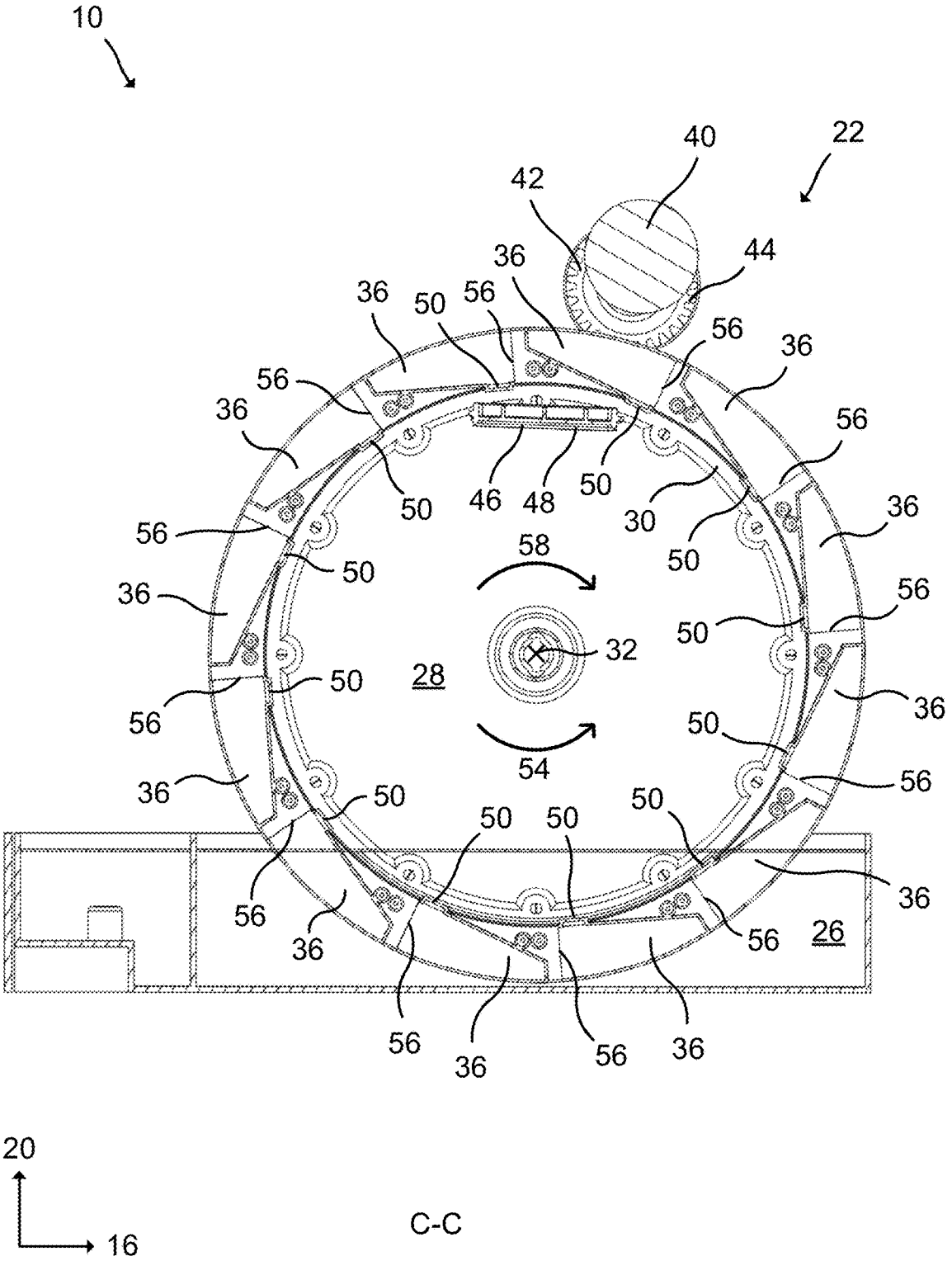
FIG. 9: represents a cross-sectional view of section C-C in FIG. 8.

FIG. 7 represents a perspective view of the interior of a further humidifying device 10. FIG. 8 represents a side view of the interior of the humidifying device 10 in FIG. 7. FIG. 9 represents a cross-sectional view of section C-C in FIG. 8. Mainly differences with respect to FIGS. 1 to 6 will be described.

With collective reference to FIGS. 7 to 9, the humidifying device 10 comprises a filter arrangement 22. The filter arrangement 22 does not comprise any wetting buckets. The rotatable body 30 and the tray 26 are arranged such that the filter member 28 supported by the rotatable body 30 is submerged in the water in the tray 26. Thus, a segment of the filter member 28 comes in contact with the water in the tray 26. For this purpose, the tray 26 may be slightly higher than the tray 26 in FIGS. 1 to 6.

By rotating the rotatable body 30 in FIGS. 7 to 9 in the second direction 54 about the rotational axis 32, different segments of the filter member 28 are brought into contact with the water in the tray 26 and the filter member 28 is thereby wetted with water from the tray 26. This type of wetting of the filter member 28 may be referred to as dip wetting. By rotating the rotatable body 30 in the first direction 58 about the rotational axis 32, each of the discharge buckets 36 arranged on the rotatable body 30 lifts water from the tray 26 and discharges the water to the guiding arrangement 46 for being guided to a discharge region. Also when the rotatable body 30 is rotated in the first direction 54 about the rotational axis 32, different segments of the filter member 28 are brought into contact with the water in the tray 26 and the filter member 28 is thereby wetted with water from the tray 26, i.e. dip wetted.

Figure 10:
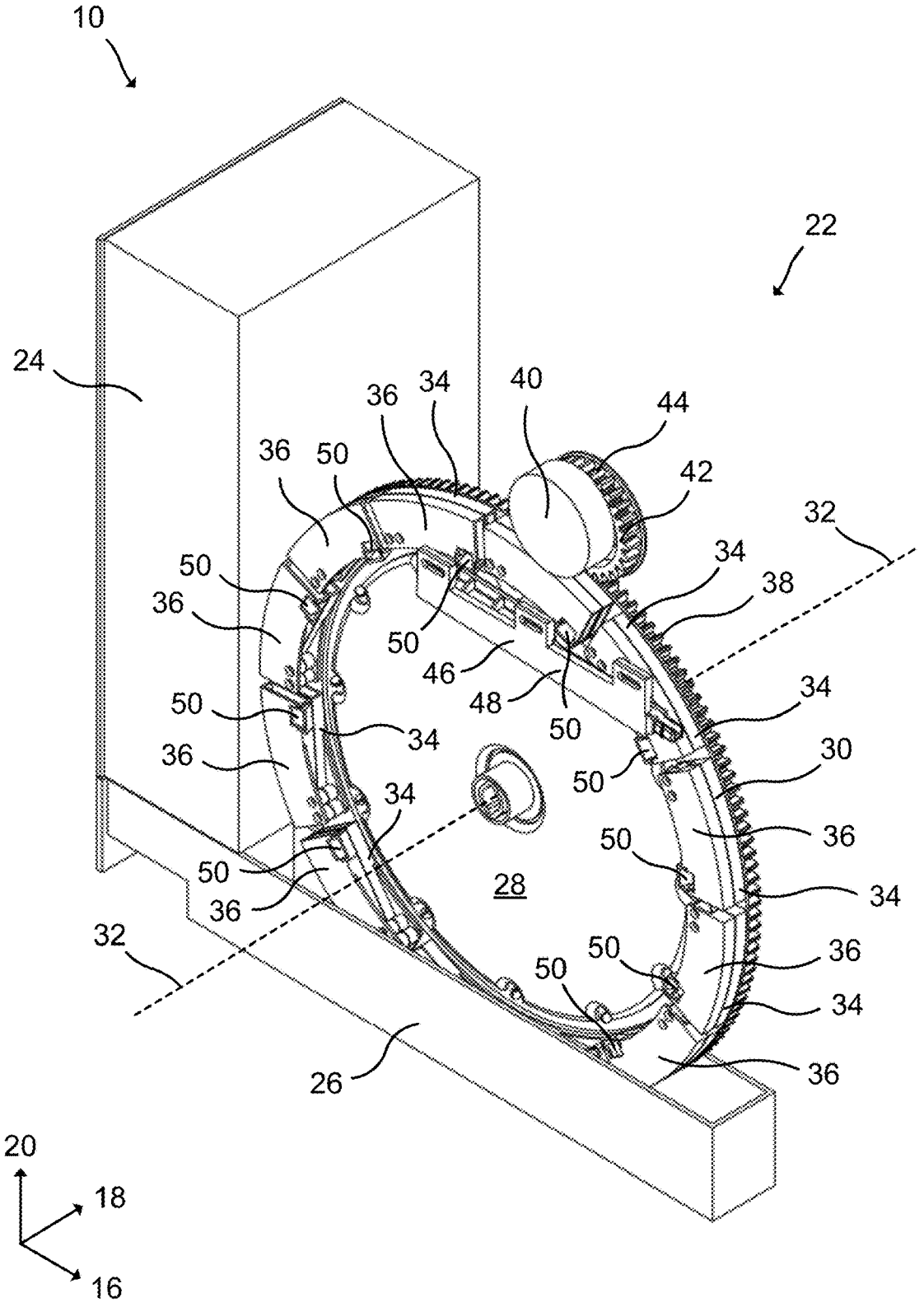
FIG. 10: represents a perspective view of the interior of a further humidifying device.
Figure 11:
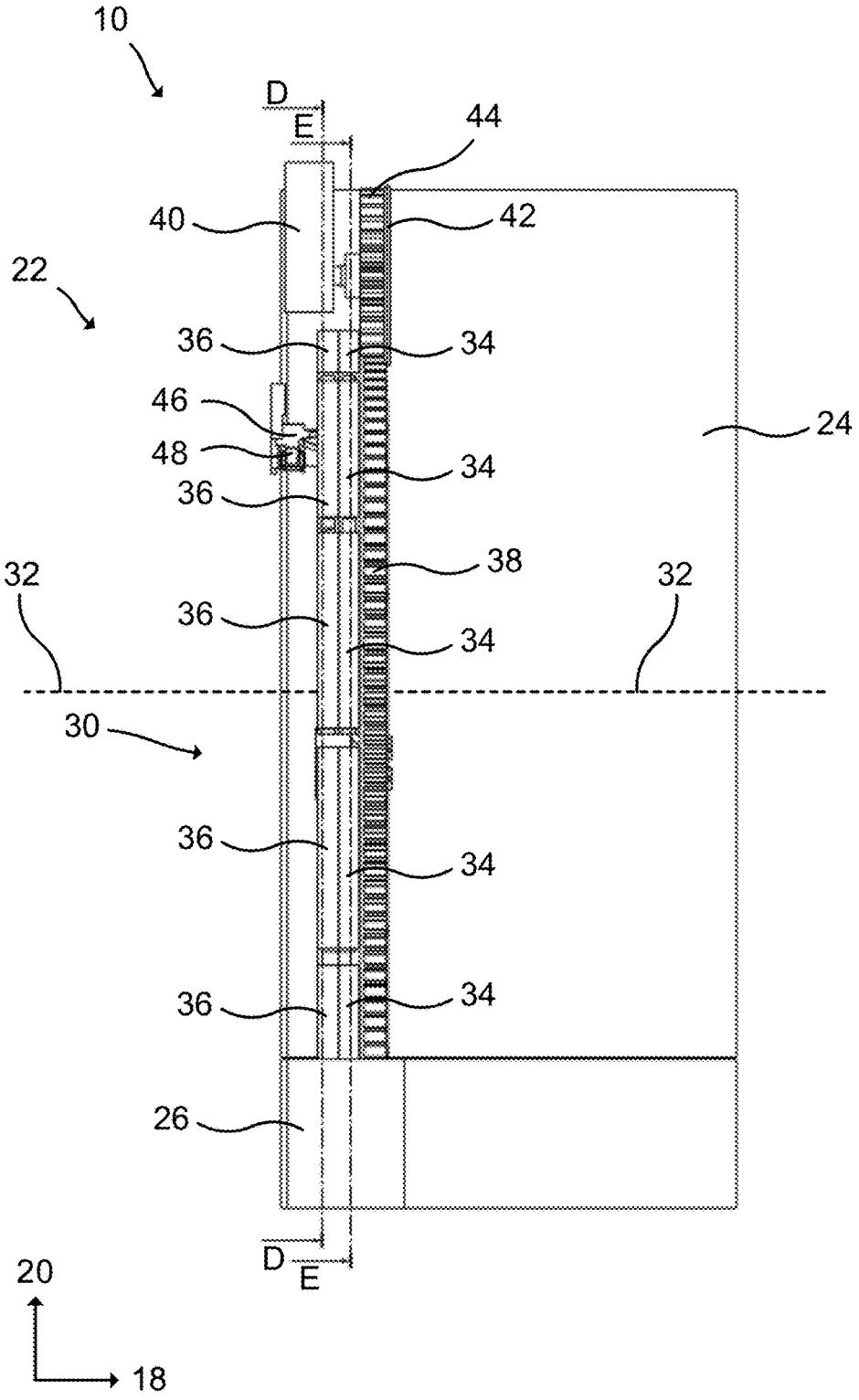
FIG. 11: represents a side view of the interior of the humidifying device in FIG. 10.
Figure 12:
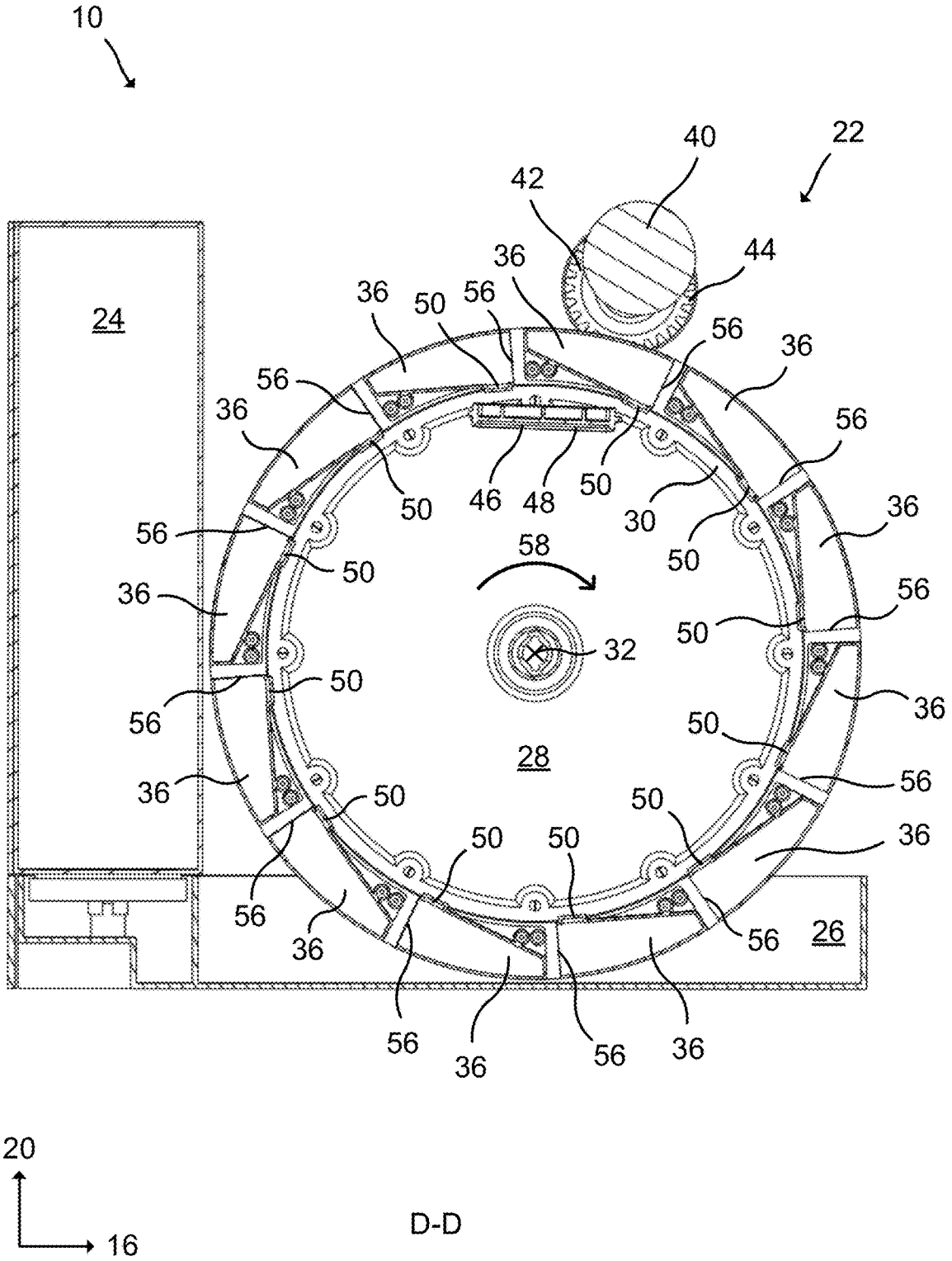
FIG. 12: represents a cross-sectional view of section D-D in FIG. 11.
Figure 13:
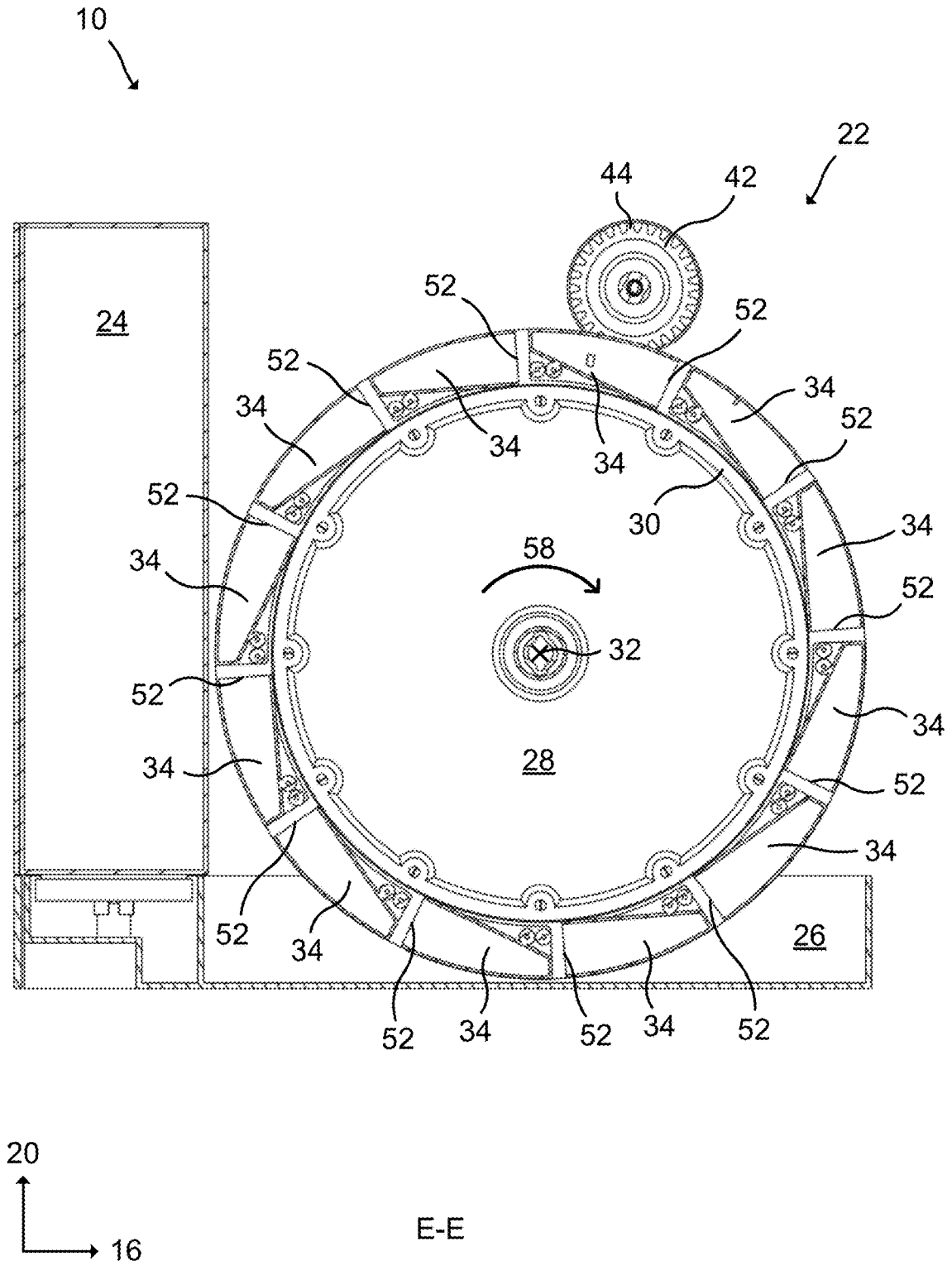
FIG. 13: represents a cross-sectional view of section E-E in FIG. 11.

FIG. 10 represents a perspective view of the interior of a further humidifying device 10. FIG. 11 represents a side view of the interior of the humidifying device 10 in FIG. 10. FIG. 12 represents a cross-sectional view of section D-D in FIG. 11. FIG. 13 represents a cross-sectional view of section E-E in FIG. 11. Mainly differences with respect to FIGS. 1 to 6 will be described.

With collective reference to FIGS. 10 to 13, the humidifying device 10 comprises a filter arrangement 22. The filter arrangement 22 comprises a plurality of wetting buckets 34 and a plurality of discharge buckets 36 arranged on the rotatable body 30. The wetting buckets 34 and the discharge buckets 36 face in the same direction around the circumference of the rotatable body 30.

By rotating the rotatable body 30 in FIGS. 10 to 13 in the first direction 58 about the rotational axis 32, each of the wetting buckets 34 lifts water from the tray 26 and sprinkles the water on the filter member 28. At the same time, i.e. when the rotatable body 30 rotates in the first direction 58, each of the discharge buckets 36 lifts water from the tray 26 and discharges the water to the guiding arrangement 46 for being guided to a discharge region.

Figure 14:
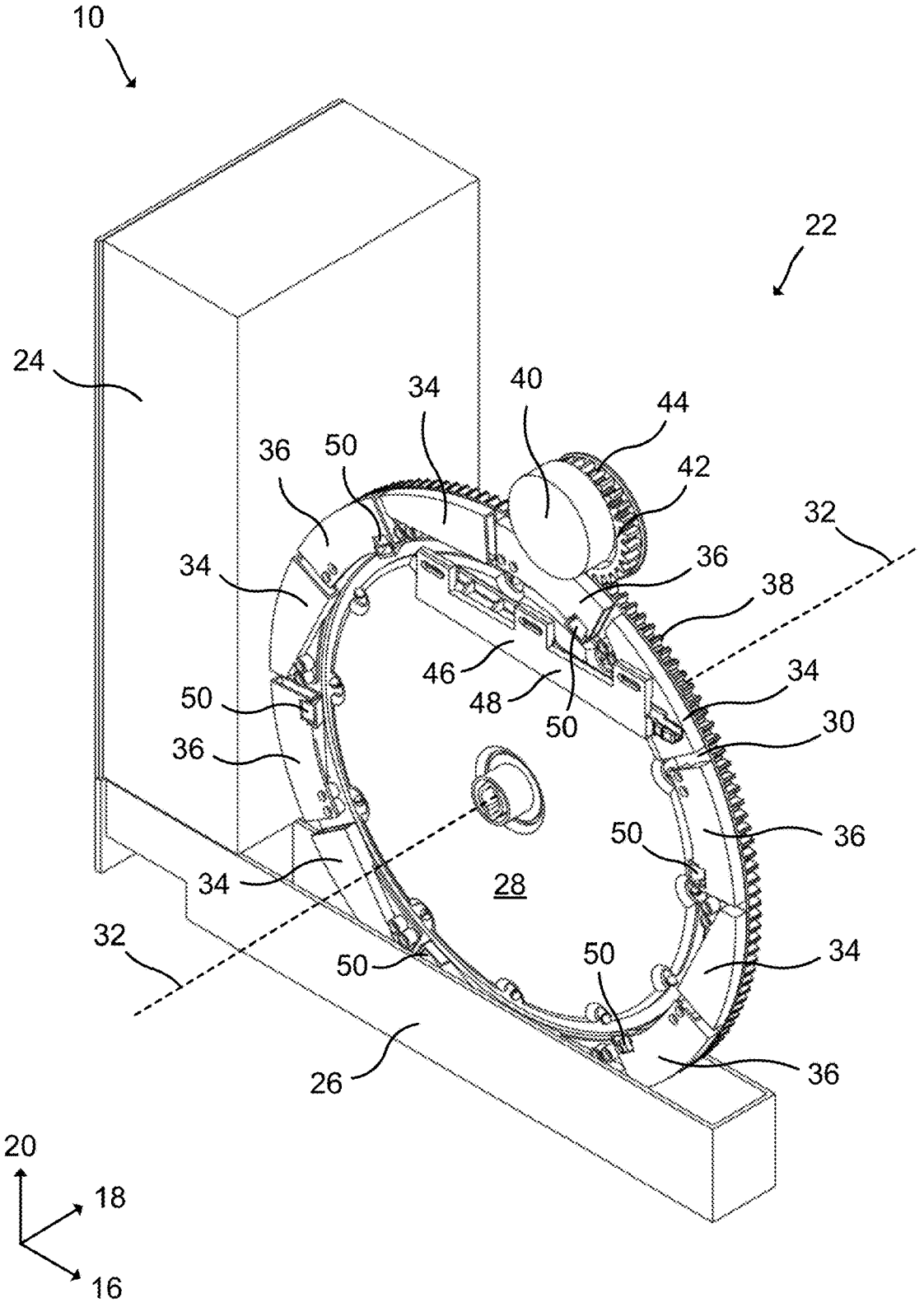
FIG. 14: represents a perspective view of the interior of a further humidifying device.
Figure 15:
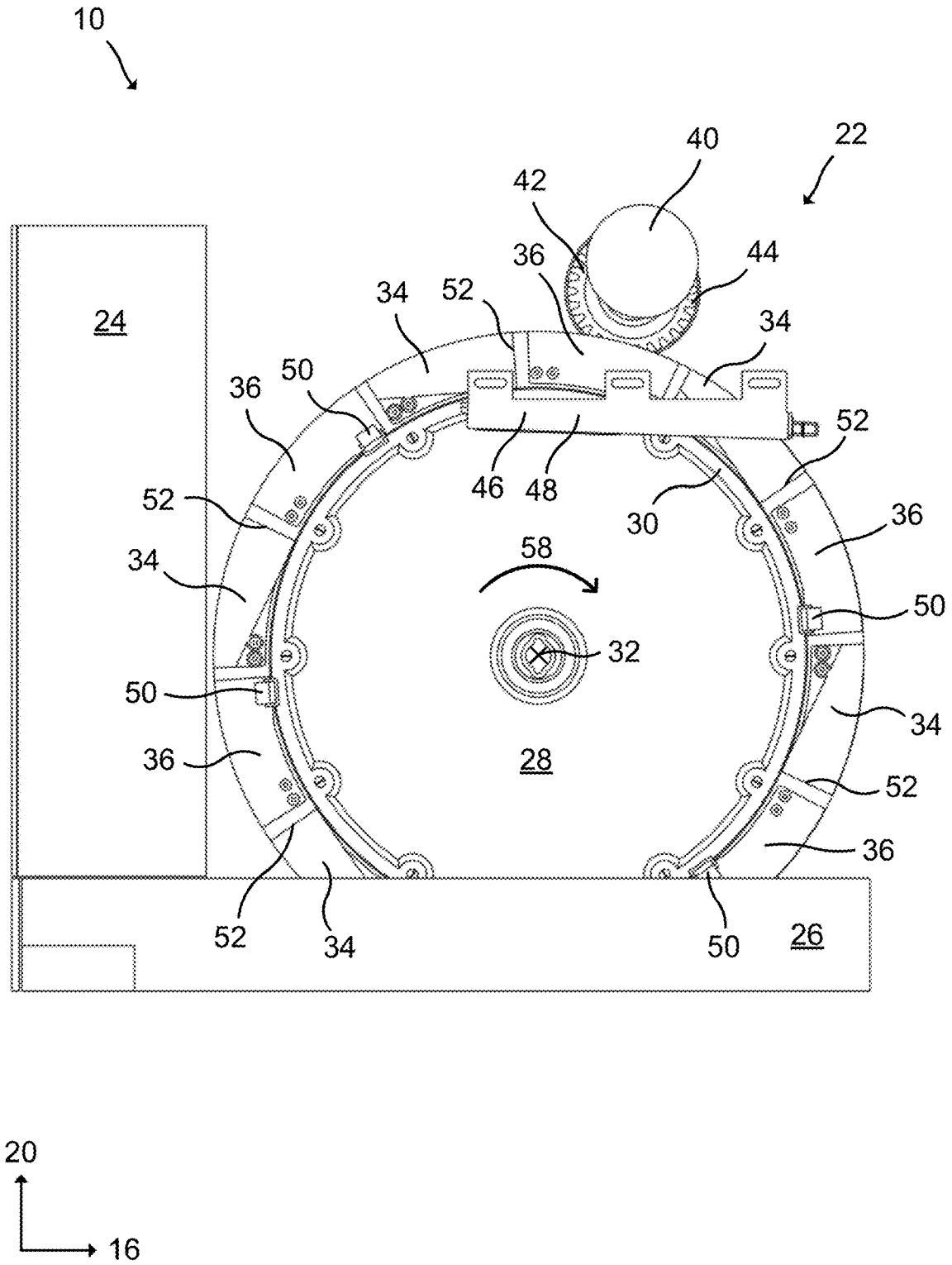
FIG. 15: represents a front view of the interior of the humidifying device in FIG. 14.

FIG. 14 represents a perspective view of the interior of a further humidifying device 10. FIG. 15 represents a front view of the interior of the humidifying device 10 in FIG. 14. Mainly differences with respect to FIGS. 1 to 6 will be described.

With collective reference to FIGS. 14 and 15, the humidifying device 10 comprises a filter arrangement 22. The filter arrangement comprises a plurality of wetting buckets 34 and a plurality of discharge buckets 36 alternatingly arranged around the circumference of the rotatable body 30. In the example of FIGS. 14 and 15, the wetting buckets 34 and the discharge buckets 36 are arranged in the same plane and face in the same direction around the circumference of the rotatable body 30.

By rotating the rotatable body 30 in the first direction 58, each of the wetting buckets 34 lifts water from the tray 26 and sprinkles the water on the filter member 28. At the same time, i.e. when the rotatable body 30 rotates in the first direction 58, each of the discharge buckets 36 lifts water from the tray 26 and discharges the water to the guiding arrangement 46.

According to a variation of the example in FIGS. 14 and 15, the discharge buckets 36 face in one direction around the circumference of the rotatable body 30 (as shown in FIGS. 14 and 15) and the wetting buckets 34 face in the opposite direction around the circumference of the rotatable body 30. In this case, by rotating the rotatable body 30 in the first direction 58 around the rotational axis 32, each of the discharge buckets 36 lifts water from the tray 26 and discharges the water to the guiding arrangement 46. By rotating the rotatable body 30 in a second direction, opposite to the first direction 58, about the rotational axis 32, each of the wetting buckets 34 lifts water from the tray 26 and sprinkles the water on the filter member 28. This variation of the example in FIGS. 14 and 15 provides for a further compact filter arrangement 22.

While the present disclosure has been described with reference to exemplary embodiments, it will be appreciated that the present invention is not limited to what has been described above. Although FIGS. 1 to 15 merely represent examples of a humidifying device 10 and a filter arrangement 22, FIGS. 1 to 15 are drawn to scale. However, it will be appreciated that the dimensions of the parts may be varied as needed. Accordingly, it is intended that the present invention may be limited only by the scope of the claims appended hereto.

The invention claimed is:

1. A filter arrangement for a humidifying device, the filter arrangement comprising:

a rotatable body;

a humidifying filter member arranged to be wetted with water;

a tray located below the rotatable body;

a guiding arrangement configured to guide water to a discharge region located outside the tray; and at least one discharge bucket arranged on the rotatable body, wherein the at least one discharge bucket is configured to lift water from the tray and to discharge the water to the guiding arrangement as the rotatable body rotates in a first direction about a rotational axis.

2. The filter arrangement according to claim 1, wherein the rotatable body comprises a rotatable filter frame supporting the filter member.

3. The filter arrangement according to claim 1, wherein each discharge bucket comprises a spout for discharging water to the guiding arrangement.

4. The filter arrangement according to claim 1, further comprising at least one rotatably arranged wetting bucket configured to lift water from the tray and to sprinkle the water on the filter member as the at least one wetting bucket rotates.

5. The filter arrangement according to claim 4, wherein the at least one wetting bucket is arranged on the rotatable body and is configured to lift water from the tray and to sprinkle the water on the filter member as the rotatable body rotates in a second direction, opposite to the first direction, about the rotational axis.

6. The filter arrangement according to claim 4, wherein the at least one wetting bucket and the at least one discharge bucket are aligned in a direction parallel to the rotational axis.

7. The filter arrangement according to claim 1, further comprising a motor arranged to drive the rotatable body in the first direction and in a second direction, opposite to the first direction, about the rotational axis.

8. The filter arrangement according to claim 7, wherein the rotatable body comprises driven teeth at a periphery of the rotatable body, wherein the filter arrangement further comprises a drive gear wheel having drive teeth in meshing engagement with the driven teeth, and wherein the motor is arranged to drive the drive gear wheel.

9. The filter arrangement according to claim 7, wherein the motor and the guiding arrangement are aligned in a direction perpendicular to the rotational axis.

10. A humidifying device comprising a filter arrangement according to claim 1.

11. A method for cleaning a humidifying filter member of a humidifying device, the method comprising:

wetting the filter member with water;

rotating a rotatable body in a first direction about a rotational axis such that at least one discharge bucket arranged on the rotatable body lifts water from a tray located below the rotatable body and discharges the water to a guiding arrangement; and guiding the water along the guiding arrangement to a discharge region located outside the tray.

12. The method according to claim 11, wherein at least one wetting bucket is arranged on the rotatable body and wherein the wetting of the filter member with water from the tray comprises rotating the rotatable body in a second direction, opposite to the first direction, about the rotational axis such that the at least one wetting bucket lifts water from the tray and sprinkles the water on the filter member.

13. The method according to claim 11, wherein the wetting of the filter member with water from the tray and the rotation of the rotatable body in the first direction are carried out repeatedly and alternatingly.

14. The method according to claim 13, wherein the wetting of the filter member with water from the tray and the rotation of the rotatable body in the first direction are carried out repeatedly and alternatingly until a predetermined condition is met.

15. The method according to claim 14, wherein the predetermined condition is based on a time limit, a number of rotations of the rotatable body, a water level in the tray and/or a water flow out from a tank or a housing of the humidifying device.

* * * * *